US005658366A

United States Patent [19]

Okamoto et al.

[11] Patent Number: 5,658,366

[45] Date of Patent: Aug. 19, 1997

[54] HEAT- AND ABRASION-RESISTANT ALUMINUM ALLOY AND RETAINER AND VALVE LIFTER FORMED THEREFROM

[75] Inventors: Kenji Okamoto; Hiroyuki Horimura; Masahiko Minemi; Kensuke Honma, all of Saitama-ken, Japan

[73] Assignee: Honda Giken Kogyo Kabushiki Kaisha, Tokyo, Japan

[21] Appl. No.: 519,578

[22] Filed: Aug. 25, 1995

[30] Foreign Application Priority Data

| | | | |
|---|---|---|---|
| Aug. 25, 1994 | [JP] | Japan | 6-224163 |
| Jun. 21, 1995 | [JP] | Japan | 7-178121 |

[51] Int. Cl.[6] ..... C22C 21/00

[52] U.S. Cl. ..... 75/235; 75/249

[58] Field of Search ..... 75/235, 249

[56] References Cited

U.S. PATENT DOCUMENTS

| | | | |
|---|---|---|---|
| 3,877,884 | 4/1975 | Tawarada et al. | 29/182.5 |
| 4,623,388 | 11/1986 | Jatkav et al. | 75/232 |
| 5,171,381 | 12/1992 | Mirchandani et al. | 148/437 |
| 5,199,971 | 4/1993 | Akechi et al. | 75/249 |
| 5,264,021 | 11/1993 | Kita et al. | 75/249 |
| 5,372,775 | 12/1994 | Hayashi et al. | 419/10 |

FOREIGN PATENT DOCUMENTS

| | | |
|---|---|---|
| 0363225 | 4/1990 | European Pat. Off. . |
| 0445684 | 9/1991 | European Pat. Off. . |
| 0487276 | 5/1992 | European Pat. Off. . |
| 0566098 | 10/1993 | European Pat. Off. . |
| 0600474 | 6/1994 | European Pat. Off. . |
| 2-2850432 | 11/1990 | Japan . |

OTHER PUBLICATIONS

Communication—European Search Report (Application No. EP 95 11 3194) dated 14 Mar. 1996.

*Primary Examiner*—Ngoclan Mai
*Attorney, Agent, or Firm*—Lyon & Lyon LLP

[57] ABSTRACT

A heat- and abrasion-resistant aluminum alloy having a grain size of the matrix of α-aluminum in the alloy not more than 1,000 nm; a grain size of an intermetallic compounds contained in the alloy of not more than 500 nm; and 0.5 to 20% by volume of ceramic particles in the range of 1.5 to 10 μm in particle size and dispersed in the alloy. By this composition, the stress concentration due to the ceramic particles is reduced. Furthermore, because the powders bind well with each other, the heat resistance and abrasion resistance are compatibly improved without decreasing toughness and ductility.

19 Claims, 5 Drawing Sheets

×200 50 μm

HEAT- AND ABRASION-RESISTANT ALUMINUM ALLOY AND RETAINER AND VALVE LIFTER FORMED THEREFROM

BACKGROUND OF THE INVENTION

1. Field of the Invention

The present invention relates to a heat- and abrasion-resistant aluminum alloy and a spring retainer and a valve lifter formed from the alloy.

2. Description of the Related Art

In recent years, various aluminum alloys with improved heat resistance and mechanical strength have been developed. A known method of producing a heat resistant aluminum alloy employs the technique of forming quenched powder followed by extrusion and so forth for the purpose of improving heat resistance. Although this kind of alloy offers high heat resistance, this does not always offer good abrasion resistance. In sliding characteristics, the level of this alloy is very similar to conventional aluminum alloys at the present stage. The plausible surface hardening methods, such as plating, involve complex processing, and hence result in increased production costs.

An aluminum alloy with relatively high abrasion resistance and mechanical strength is disclosed, for example, in JP-A-2-285043 entitled "An Al—Si alloy powder forging material with extremely low thermal expansion coefficient". The aluminum alloy contains 35 to 45% by weight of primary crystal Si with a particle size of 2 to 15 μm and 5 to 20% by volume of aluminum oxide with a particle size of 5 to 20 μm.

However, because aluminum oxide particles are included in its texture which comprises the matrix of the order of several tens of μm and Si crystals of a relatively large particle size, around 10 μm, the known alloy, though its abrasion resitance may be improved, has a drawback in that the strain is likely to concentrate due to the influence of the Si crystals and aluminum oxide particles present therein. Further, the known material may have some other defects due to the non-homogeneity of the powder deformation that may occur during the forming and hardening process thereof, leading to decreased toughness and strength after fatigue.

SUMMARY OF THE INVENTION

The present inventors have investigated aluminum alloys with the knowledge that the particle size and the composition of the ceramics are essential features for the improvement in the alloy. During the investigation, an aluminum alloy, which offers the compatibility between heat resistance and abrasion resistance and does not cause the decrease in toughness, was satisfactorily found by means of the optimization of the texture in the alloy matrix and the selection of an optimum particle size of the ceramics added in the matrix.

An object of the present invention is to provide a heat- and abrasion-resistant aluminum alloy comprising: a matrix of α-aluminum contained in the alloy and having a grain size of not more than 1,000 nm; intermetallic compounds contained in the alloy and having a grain size of not more than 500 nm; and 0.5 to 20% by volume of ceramic particles dispersed in the alloy and having a particle size in the range of 1.5 to 10 μm.

A further object of the present invention is to provide a heat- and abrasion-resistant aluminum alloy with improved workability by limiting the ceramic particle content to 0.5 to 8% by volume.

Another object of the present invention is to provide an aluminum alloy having a preferable composition of $Al_{bal}TM_aX_b$, wherein TM is at least one element selected from the group of Fe and Ni, X is at least one element selected from the group of Ti, Zr, Mg and rare earth elements, and a and b in atomic percentage are $4 \leqq a \leqq 7$ and $0.5 \leqq b \leqq 3$, respectively.

Yet another object of the present invention is to provide an aluminum alloy having a preferable composition of $Al_{bal}TM_aX_bSi_c$, wherein TM is at least one element selected from the group of Fe and Ni, X is at least one element selected from the group of Ti, Zr, Mg and rare earth elements, and a, b, and c in atomic percentage are $4 \leqq a \leqq 7$, $0.5 \leqq b \leqq 3$ and $1 \leqq c \leqq 3$, respectively.

The ceramic particles according to the invention are preferably non-spherical with an oval like cross section.

Still another object of the present invention is to provide a heat- and abrasion-resistant valve spring retainer and a valve lifter, both formed from the aluminum alloy of the invention.

BRIEF DESCRIPTION OF THE DRAWINGS

The details of the invention will now be described having reference to the accompanying drawings, in which.

DESCRIPTION OF THE PREFERRED EMBODIMENTS

The details of the examples according to the invention will now be explained but these examples are only for illustration and should not be construed as limiting the invention.

EXAMPLES 1 TO 6 AND COMPARATIVE EXAMPLES 1 TO 5

Test pieces were prepared based on the following procedure in order to carry out various tests.

Preparation of a Green Compact

An alloy having a composition of $Al_{91}Fe_6Ti_1Si_2$ (where the suffix means atomic percent) was air-atomized and classified to 45 μm or less. $Al_2O_3$ particles having an average diameter of 3.5 μm were added into the alloy in an quantity of 0 to 35 volume percent and the compound was mixed thoroughly. Then, a green compact billet of 55 mm in outer diameter by 55 mm in length was prepared from the mixture by CIP (Cold Isostatic Pressing) under a pressure of 4 ton/cm$^2$.

Degassing of the Green Compact

The green compact prepared was placed into a muffle furnace at 530° C. and allowed to degas for 15 minutes in an argon atmosphere.

Extrusion

The test piece was prepared based on the following indirect extrusion conditions:

| | |
|---|---|
| Inner diameter of container | 56 mm |
| Container temperature | 400° C. |
| Bore diameter of die | 15 mm |
| Die temperature | 400° C. |
| Extruding speed | 0.5 to 1.0 m/sec |

Observation of Texture in Test Piece

Figure 1:
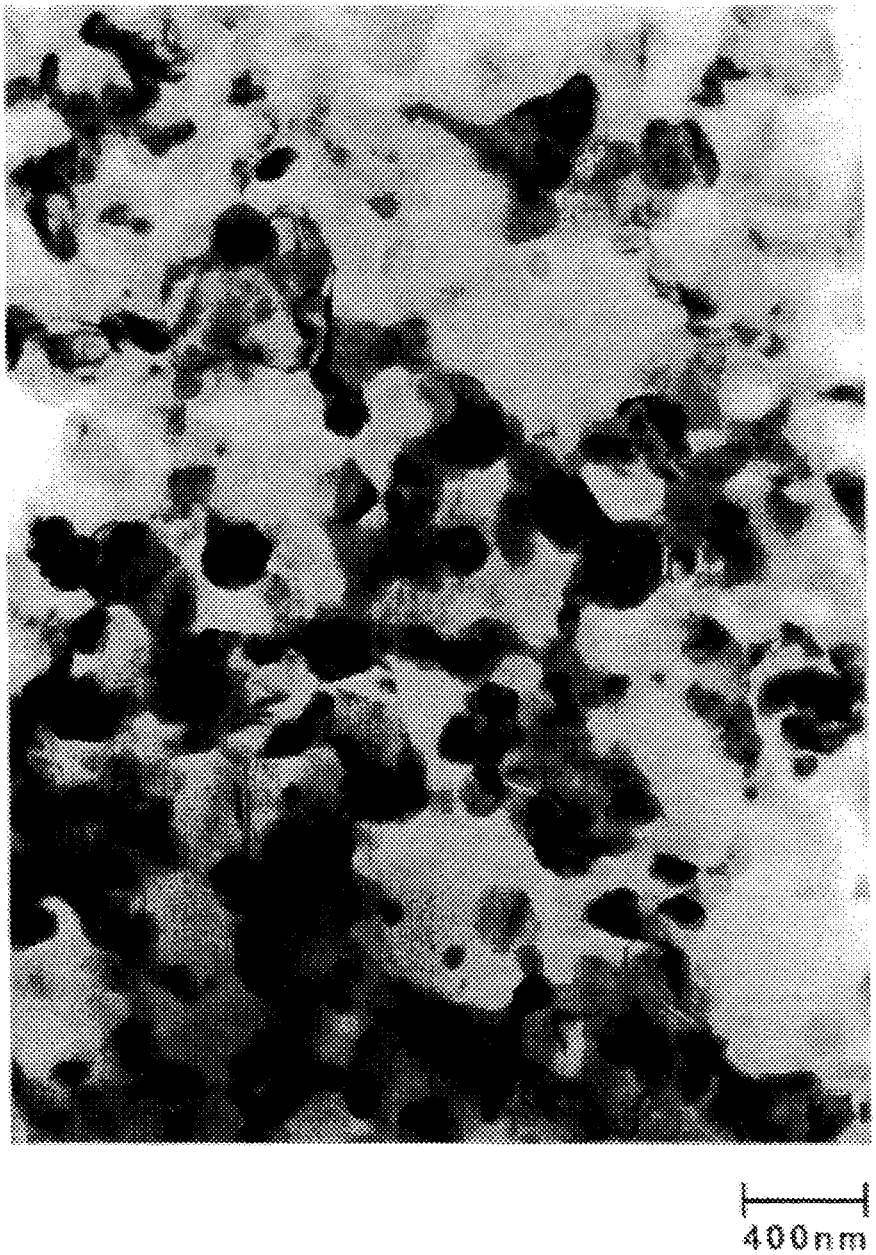
FIG. 1 is a TEM (Transmission Electron Microscope) photograph showing the texture of Example 2 of the invention.

For illustration purposes, of these eleven Examples (invention Examples 1–6 and Comparative Examples 1–5), FIG. 1 is a TEM (Transmission Electron Microscope) photograph showing the texture of the sample of Example 2 of the invention. The bright large objects are α-aluminum matrix grains (fcc grains) and their size is measured as 500 nm on average with the scale indicated at the lower right of the photograph. The dark fields in the photograph are intermetallic compounds (IMC) having an average diameter of 200 nm. No ceramic particle is found in the photograph. The average sizes of the fcc grains and the IMC grains were determined by measuring each 50 particles which were selected at random in the TEM photograph.

Figure 2:
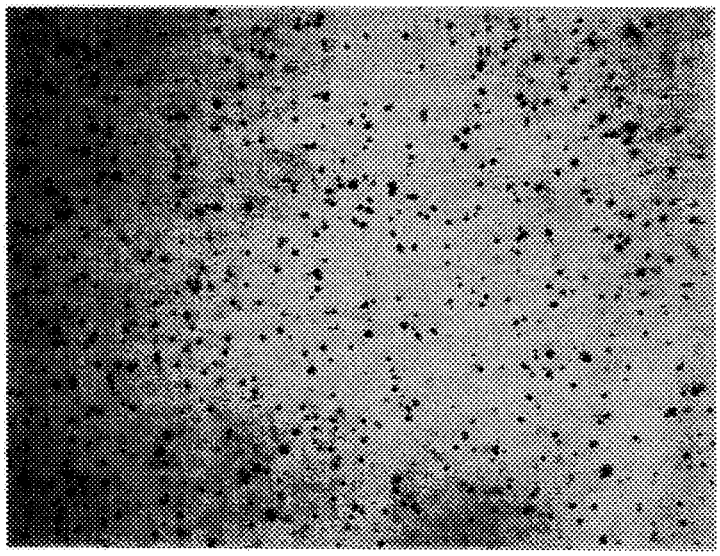
FIG. 2 is a optical microscope photograph showing the texture of Example 2 of the invention.

FIG. 2 is an optical photograph at 200 magnifications, in which the scale is indicated at the lower right, showing the texture of Example 2 of the invention. Although it may be difficult to distinguish between the fcc grains and the IMC, black dots having a few μm of diameter represent ceramic particles.

The grain and particle sizes in each sample of the Examples and Comparative Examples were based on the above procedures.

Each sample was used for the following tests.

Tensile Test at High Temperature

The test was carried out at 200° C.

Charpy Impact Test

A smooth test piece without a notch was used for the Charpy impact test.

Sliding Abrasion Test

The amount of abrasion was determined by the sliding test based on the following conditions:

| | |
|---|---|
| Test piece | Formed to 10 mm by 10 mm by 5 mm |
| Rotating disc | Silicon-Chromium steel 135 mm in diameter (JIS SWOSC- carburizing steel) |
| Sliding speed | 25 m/sec |
| Sliding pressure | 200 kg/cm$^2$ |
| Lubricant feed speed | 5 cc/sec |
| Sliding distance | 18 km |
| Amount of abrasion | Reduced thickness in μm |

The test results are shown in Table 1 below.

TABLE 1

| Sample Number | $Al_2O_3$ (vol %) | Tensile Strength (MPa) | Elongation at break (%) | Impact Strength (J/mm$^2$) | Abrasion Loss (μm) | Evaluation |
|---|---|---|---|---|---|---|
| Comparative Example 1 | 0 | 400 | 8.0 | 0.18 | 18.4 | N.G. |
| Comparative Example 2 | 0.3 | 398 | 8.1 | 0.18 | 4.0 | N.G. |
| Example 1 | 0.5 | 401 | 8.0 | 0.19 | 0.4 | Good |
| Example 2 | 1 | 403 | 7.9 | 0.18 | 0.2 | Good |
| Example 3 | 5 | 400 | 8.0 | 0.17 | 0.1 | Good |
| Example 4 | 10 | 405 | 7.7 | 0.16 | 0.1 | Good |
| Example 5 | 15 | 407 | 7.6 | 0.15 | 0.1 | Good |
| Example 6 | 20 | 411 | 7.5 | 0.15 | 0.1 | Good |
| Comparative Example 3 | 25 | 415 | 3.0 | 0.06 | 0.1 | N.G. |
| Comparative Example 4 | 30 | 418 | 3.0 | 0.05 | 0.1 | N.G. |
| Comparative Example 5 | 35 | 420 | 2.8 | 0.04 | 0.1 | N.G. |

Comparative Example 1

This sample, which does not contain $Al_2O_3$ in the $Al_{91}Fe_6Ti_1Si_2$ matrix, exhibits poor abrasion property. Its abrasion loss is 18.0 μm.

Comparative Example 2

Although this sample that had 0.3% by volume of $Al_2O_3$ added into the matrix demonstrates an improved abrasion property, the abrasion loss of 4.0 μm is still a poor level.

Example 1

The sample, which contains 0.5% by volume of $Al_2O_3$ in the matrix, exhibits 8.0% in elongation, 0.19 J/mm$^2$ in impact strength, and 0.4 μm in abrasion loss which is satisfactorily improved.

Examples 2 to 5

These four samples, in which 1.0, 5.0, 10, or 15% by volume of $Al_2O_3$ were added, were tested and exhibited 7.9, 8.0, 7.7, or 7.6% in elongation, and 0.18, 0.17, 0.16, or 0.15 J/mm$^2$ in impact strength, respectively. The abrasion loss of each sample is less than 0.2 μm which is a highly satisfactory level.

Example 6

The sample that had 20% by volume of $Al_2O_3$ added into the matrix exhibits the properties at a satisfactory level: 7.5% in elongation and 0.15 J/mm$^2$ in impact strength, where elongation and impact strength show a little decrease as compared with Example 1, and only 0.1 μm in abrasion loss.

Comparative Example 3

By adding 25% by volume of $Al_2O_3$ into the matrix, the elongation and impact strength significantly decrease as compared with Example 6; i.e. in elongation, and 0.06 J/mm$^2$ in impact strength, whereby the sample is not satisfactory.

Comparative Examples 4 and 5

By adding 30 or 35% by volume of $Al_2O_3$ into the matrix, further decreases in elongation and impact strength are observed in each sample. These samples also are not satisfactory.

As the above results demonstrate, excessive abrasion loss is observed in the samples containing less than 0.5% by volume of $Al_2O_3$ and the toughness of each sample containing over 20% by volume of $Al_2O_3$ drastically decreases, whereby approximately 0.5 to 20% by volume of $Al_2O_3$ addition is preferable.

EXAMPLES 7 TO 10 AND COMPARATIVE EXAMPLES 6 AND 7

The effect of size of the added ceramic particles on the properties was examined. The amount of added $Al_2O_3$ was fixed at 2.5% by volume, and the particle size was varied from 1.2 to 12.0 μm in diameter. Other conditions and tests were the same as Example 1. The test results for these Examples are shown in Table 2 below.

TABLE 2

| Sample Number | $Al_2O_3$ Average Size (PM) | Tensile Strength (MPa) | Elongation at break (%) | Impact Strength (J/mm$^2$) | Al Alloy Abrasion Loss (μm) | Disk Abrasion Loss (μm) | Evaluation |
|---|---|---|---|---|---|---|---|
| Comparative Example 6 | 1.2 | 402 | 8.2 | 0.18 | 9.1 | 0.1 | N.G. |
| Example 7 | 1.5 | 400 | 8.1 | 0.18 | 0.1 | 0.1 | Good |
| Example 8 | 3.0 | 401 | 8.2 | 0.18 | 0.2 | 0.1 | Good |
| Example 9 | 8.0 | 399 | 8.0 | 0.18 | 0.2 | 0.1 | Good |
| Example 10 | 10.0 | 403 | 8.1 | 0.18 | 0.1 | 0.1 | Good |
| Comparative Example 7 | 12.0 | 400 | 7.9 | 0.17 | 0.2 | 4.1 | N.G. |

Comparative Example 6

The use of $Al_2O_3$ having an average particle size of 1.2 μm in diameter causes an excessive abrasion loss, i.e. 9.1 μm, of the aluminum alloy test piece.

Examples 7, 8, 9, and 10

These four samples were prepared by varying the average particle size of $Al_2O_3$ to 1.5, 3.0, 8.0, and 10.0 μm in diameter, respectively. The results of abrasion loss of the aluminum alloy and the disc of each example are in the range of 0.1 to 0.2 μm, which is satisfactory.

Comparative Example 7

By increasing the average particle size of $Al_2O_3$ to 12.0 μm in diameter, an excessive abrasion loss of the rotating disc was observed, which is unsatisfactory.

When the average particle size of $Al_2O_3$ is less than 1.5 μm in diameter, the abrasion resistance of the aluminum alloy decreases, while the aluminum alloy containing $Al_2O_3$ over 10.0 μm in average particle diameter causes severe abrasion loss of the counterpart. Therefore, the average size of $Al_2O_3$ is preferably in the range of approximately 1.5 to 10.0 μm in diameter.

EXAMPLES 11 TO 15 AND COMPARATIVE EXAMPLES 8 TO 18

The test pieces were prepared under the following procedures and subjected to various tests.

Preparation of a Green Compact

Four alloys having different compositions, $Al_{93}Fe_4Y_3$, $Al_{92}Fe_6Zr_2$, $Al_{92}Ni_5Mm_3$, and $Al_{90}Fe_6Ti_1Si_2Mg_1$ (where the suffix means atomic percent) were classified to not more than 45 μm after air-atomization, $Al_2O_3$ particles having 2.5 μm in average diameter were added in a quantity corresponding to 3.0% by volume, and the compound was mixed thoroughly in a mixer. Then, a green compact billet of 55 mm in outer diameter by 55 mm in length was prepared from the mixture by CIP (Cold Isostatic Pressing) under a pressure of 4 ton/cm$^2$.

Mm is the abbreviation of Mischmetal which is the common name of the composite materials containing La and/or Ce as major element, other rare earth elements (Lanthanoid) except for La and Ce, and unavoidable impurities such as Si, Fe, Mg, Al and so on.

Degassing of the Green Compact

Each green compact prepared was degassed in an argon atmosphere under the conditions of heating temperature and time as shown in Table 3.

Extrusion

The test piece was prepared based on the following indirect extrusion conditions:

| | |
|---|---|
| Inner diameter of container | 56 mm |
| Container temperature | 400° C. |
| Bore diameter of die | 15 mm |
| Die temperature | 400° C. |
| Extruding speed | 0.5 to 1.0 m/sec |

Observation of the Texture in Test Piece

Through TEM (Transmission Electron Microscope) observation of the texture of each test piece, the diameter of the α-aluminum matrix grains (fcc grains) and the diameter of the intermetallic compound (IMC) were obtained and are shown in Table 3. These grain diameters are the averaged measurements of 50 grains randomly selected from each of the fcc and IMC grains in the TEM photograph.

The following tests then were carried out with respect to each test piece.

Tensile Test at High Temperature

The test was carried out at 200° C.

Charpy Impact Test

A smooth test piece without a notch was used for the Charpy impact test.

Sliding Abrasion Test

The amount of abrasion was determined by a sliding test based on the following conditions:

| | |
|---|---|
| Test piece | Formed to 10 mm by 10 mm by 5 mm |
| Rotating disc | Silicon-Chromium steel 135 mm in diameter (JIS SWOSC - carburizing steel) |
| Sliding speed | 25 m/sec |
| Sliding pressure | 200 kg/cm$^2$ |
| Lubricant feed speed | 5 cc/sec |
| Sliding distance | 18 km |
| Amount of abrasion | Reduced thickness in μm |

The results of the tests of these Examples are shown in Table 3 below.

Example 12

In this sample, $Al_{92}Fe_6Zr_2$ containing $Al_2O_3$ was degassed at 500° C. for 1.5 hr. The fcc grain size and IMC grain size were 800 nm and 300 nm, respectively. The result of the Charpy impact test was 0.18 J/mm$^2$ and the abrasion loss was 0.2 μm. Both properties are a satisfactory level.

Similarly, because the samples not containing $Al_2O_3$ of Comparative Examples 12, 14, 15, 17, and 18 result in excessive abrasion losses of 16 to 18 μm, these samples are not suitable for the alloy of the invention.

Although the samples of Comparative Examples 13 and 16 contained 3.0% by volume of $Al_2O_3$, the fcc and IMC grain sizes in each sample are too large, and the results of the Charpy impact test decreased to an unsatisfactory level.

On the other hand, the samples containing 3.0% by volume of $Al_2O_3$ of the Examples 13, 14, and 15 result in excellent abrasion loss and Charpy impact test properties because of the fine fcc and IMC grain sizes in these samples.

The results shown in Table 3 demonstrate that fcc grain size should be not more than about 1,000 nm and IMC grain size should be not more than about 500 nm in order to obtain desirable Charpy impact test and abrasion loss properties.

TABLE 3

| Sample Number | Composition (Atomic %) | Heading Temperature (°C.) | Heating Time (hr) | fcc Particle Size (nm) | IMC Particle Size (nm) | Tensile Strength (MPa) | Elongation at break (%) | Impact (Strength (J/mm$^2$) | Abrasion Loss (μm) | Evaluation |
|---|---|---|---|---|---|---|---|---|---|---|
| Comparative Example 8 | $Al_{93}Fe_4Y_3$ | 500 | 1.5 | 1000 | 500 | 403 | 10.8 | 0.29 | 18 | N.G. |
| Example 11 | $Al_{93}Fe_4Y_3 + Al_2O_3$ | 500 | 1.5 | 1000 | 500 | 405 | 10.8 | 0.28 | 0.1 | Good |
| Comparative Example 9 | $Al_{93}Fe_4Y_3$ | 550 | 2.0 | 1100 | 600 | 386 | 11.9 | 0.34 | 18 | N.G. |
| Comparative Example 10 | $Al_{93}Fe_4Y_3+Al_2O_3$ | 550 | 2.0 | 1100 | 600 | 385 | 4.0 | 0.11 | 0.2 | N.G. |
| Comparative Example 11 | $Al_{92}Fe_6Zr_2$ | 500 | 1.5 | 800 | 300 | 542 | 5.0 | 0.18 | 17 | N.G. |
| Example 12 | $Al_{92}Fe_6Zr_2 + Al_2O_3$ | 500 | 1.5 | 800 | 300 | 545 | 5.1 | 0.18 | 0.2 | Good |
| Comparative Example 12 | $Al_{92}Fe_6Zr_2$ | 550 | 3.5 | 1150 | 500 | 511 | 7.0 | 0.21 | 16 | N.G. |
| Comparative Example 13 | $Al_{92}Fe_6Zr_2 + Al_2O_3$ | 550 | 3.5 | 1150 | 500 | 461 | 0.3 | 0.09 | 0.1 | N.G. |
| Comparative Example 14 | $Al_{92}Ni_5Mm_3$ | 450 | 2.5 | 750 | 400 | 501 | 6.8 | 0.22 | 16 | N.G. |
| Example 13 | $Al_{92}Ni_5Mm_3 + Al_2O_3$ | 450 | 2.5 | 750 | 400 | 503 | 6.9 | 0.21 | 0.1 | Good |
| Comparative Example 15 | $Al_{92}Ni_5Mm_3$ | 500 | 1.5 | 950 | 550 | 498 | 7.5 | 0.25 | 17 | N.G. |
| Comparative Example 16 | $Al_{92}Ni_5Mm_3 + Al_2O_3$ | 500 | 1.5 | 950 | 550 | 499 | 1.2 | 0.10 | 0.1 | N.G. |
| Comparative Example 17 | $Al_{90}Fe_6Ti_1Si_2Mg_1$ | 500 | 1.5 | 550 | 350 | 405 | 9.9 | 0.17 | 18 | N.G. |
| Example 14 | $Al_{90}Fe_6Ti_1Si_2Mg_1 + Al_2O_3$ | 500 | 1.5 | 550 | 350 | 408 | 10.0 | 0.17 | 0.2 | Good |
| Comparative Example 18 | $Al_{90}Fe_6Ti_1Si_2Mg_1$ | 530 | 3 | 900 | 450 | 370 | 11.0 | 0.22 | 18 | N.G. |
| Example 15 | $Al_{90}Fe_6Ti_1Si_2Mg_1 + Al_2O_3$ | 530 | 3 | 900 | 450 | 372 | 10.9 | 0.21 | 0.1 | Good |

Comparative Example 8

This sample using $Al_{93}Fe_4Y_3$ matrix was degassed at the condition of temperature and time shown in Table 3. Because the matrix does not contain the ceramic, $Al_2O_3$, the abrasion loss was 18 μm, which is an extremely poor level.

Example 11

This sample, $Al_{93}Fe_4Y_3$ matrix containing 3.0% by volume of $Al_2O_3$, resulted in a 0.1 μm abrasion loss, which is a satisfactory level.

Comparative Example 9

This sample does not contain $Al_2O_3$ (like Comparative Example 8). The abrasion loss was 18 μm, which is an extremely poor level.

Comparative Example 10

This sample containing 3% by volume of $Al_2O_3$ in the sample of Comparative Example 9 resulted in a 0.1 μm abrasion loss which is a satisfactory level. However, the fcc particle size and IMC particle size increased to 1,100 nm and 600 nm, respectively, compared with those sizes of Example 11, i.e. 1,000 nm and 500 nm, due to the change of the heating temperature from 500° C. of Example 11 to 550° C. and the heating time from 1.5 hr to 2.0 hrs. As a result, the Charpy impact test value decreased unsatisfactorily.

Comparative Example 11

In this sample, $Al_{92}Fe_6Zr_2$ as the matrix was used instead of $Al_{93}Fe_4Y_3$. Because the sample also does not contain $Al_2O_3$, the abrasion loss was 17 μm, which is an extremely poor level.

EXAMPLES 20 TO 24 AND COMPARATIVE EXAMPLES 20 TO 22

The samples shown in Table 4 below are the samples upset at high temperature the same matrix as the samples shown in Table 1, except for different $Al_2O_3$ volume contents, with these samples being subjected to secondary formability tests.

Test pieces having 8 mm in outer diameter and 12 mm in length were prepared, and upset by applying force from the top in the direction of the length after heating to 400° C. until a crack occurs. When the critical height remaining at the crack occurrence is h, the upsetting ratio is expressed by the equation, (h÷12)×100 (%), where 12 means the initial height.

TABLE 4

| Sample Number | $Al_2O_3$ (Vol %) | Upset Ratio (%) |
|---|---|---|
| Comparative Example 20 | 0 | 60 |
| Example 20 | 0.5 | 60 |
| Example 21 | 1 | 60 |
| Example 22 | 5 | 55 |
| Example 23 | 7 | 55 |
| Example 24 | 8 | 55 |
| Comparative Example 21 | 9 | 25 |
| Comparative Example 22 | 10 | 25 |

Upset Ration $= \frac{h}{12} \times 100(\%)$

The samples of Comparative Example 20 and Examples 20 to 24 offer good formability due to high upsetting ratio of more than 55%.

On the other hand, the samples of Comparative Examples 21 and 22 which contain more $Al_2O_3$ are brittle, so that the upsetting ratios of these samples are only 25% indicating poor formability.

Accordingly, preferable secondary formability will be achieved in the range of 0.5 to 8.0% by volume of $Al_2O_3$ content.

EXAMPLES 25 AND 26 AND COMPARATIVE EXAMPLE 23

Then the effect of the shape of the ceramic particles added were examined.

Figure 3:
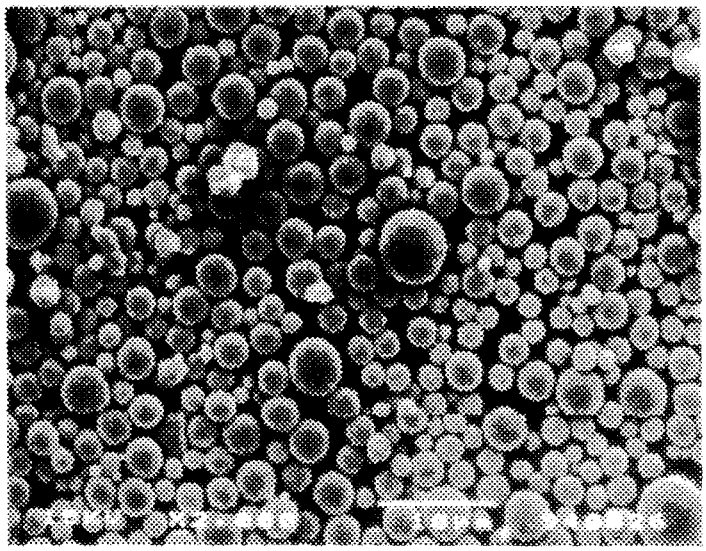
FIG. 3 is a SEM (Scanning Electron Microscope) photograph of $Al_2O_3$ particles mixed into the matrix for the preparation of the test piece in Example 25 in the invention.

FIG. 3 is a SEM (Scanning Electron Microscope) photograph of the $Al_2O_3$ particles which are contained in the matrix to prepare the test piece of Example 25 of the invention. The sample of Example 25 is the same as that of the above-mentioned Example 3. In the photograph, the shape of the $Al_2O_3$ particles is almost spherical.

Figure 4:
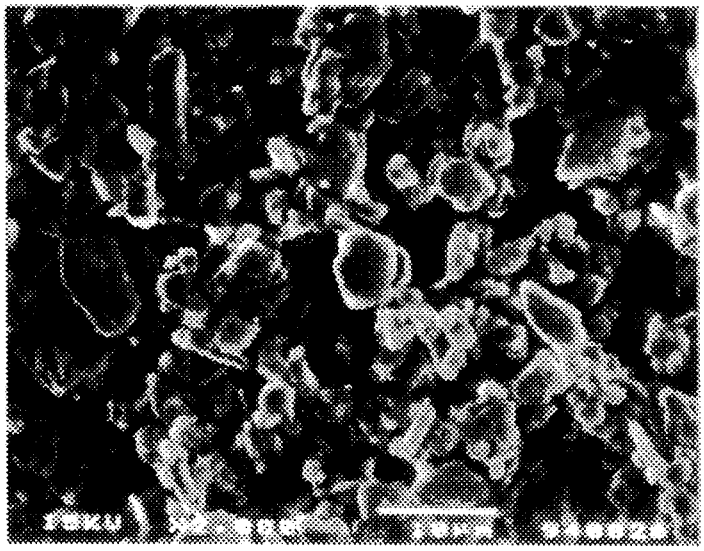
FIG. 4 is a SEM photograph of $Al_2O_3$ particles mixed into the matrix for the preparation of the test piece in Example 26 in the invention.

FIG. 4 is a SEM photograph of the $Al_2O_3$ particles which are contained in the matrix to prepare the test piece of Example 26 of the invention. In the photograph, the shape of the $Al_2O_3$ particles is not spherical, but the cross section is relatively oval.

Figure 5:
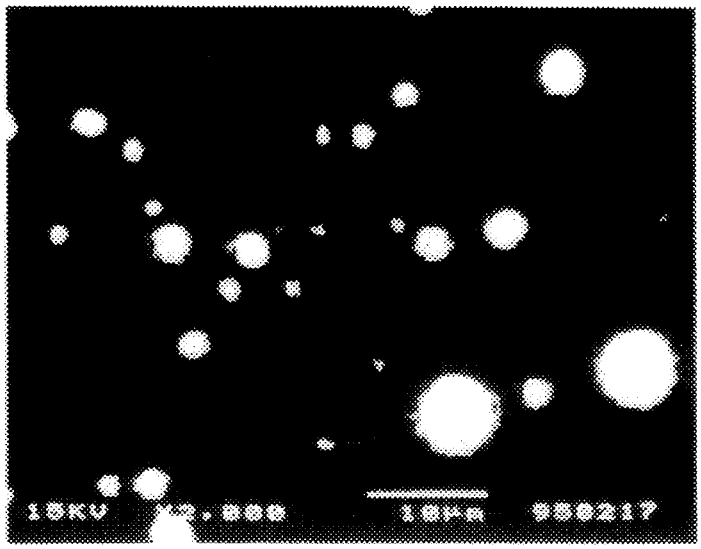
FIG. 5 is a SEM photograph showing the texture of the test piece in Example 25 in the invention.

FIG. 5 is a SEM photograph (taken as a reflected electron image) of the texture of the test piece of Example 25 in the invention. The bright fields of the photograph indicated that the $Al_2O_3$ particles are spherical.

Figure 6:
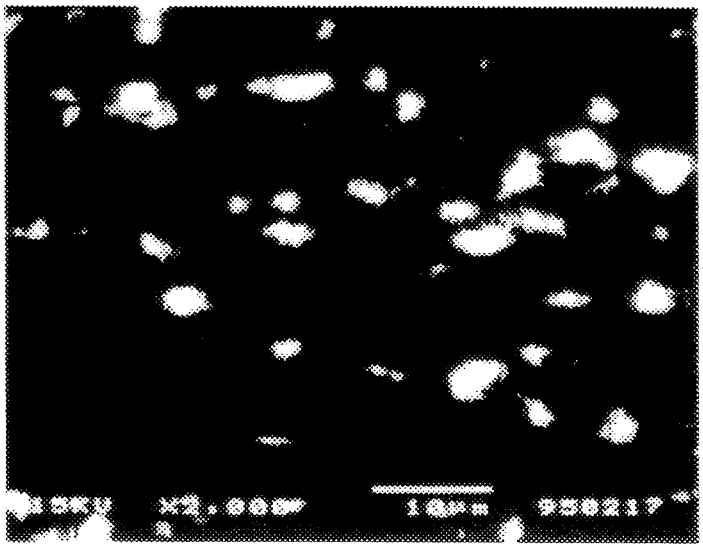
FIG. 6 is a SEM photograph showing the texture of the test piece in Example 26 in the invention.

FIG. 6 is a SEM photograph (reflected electron image) of the texture of the test piece of Example 26 of the invention. In this sample, the bright fields of the photograph indicate that the $Al_2O_3$ particles are not spherical, but rather are oval, rectangular or like a gourd.

The sizes of the $Al_2O_3$ particles were defined as follows: the particle image was put between two parallel lines and these parallel lines were rotated along the edge of the image. The width was defined as the minimum interval between the parallel lines, and the length was defined as the interval between two other parallel lines which are perpendicular to the former parallel lines at the minimum interval and circumscribed with the edge of the image, with the length representing the particle size. The aspect ratio means the ratio of the length to the width. The aspect ratio was determined by measuring and averaging the size of 50 $Al_2O_3$ particle images in FIG. 5 and FIG. 6.

The test pieces of Examples 25 and 26 have the same composition except for the shape of the ceramic added, i.e. $Al_2O_3$ particles. The $Al_2O_3$ particles in the sample in Example 25 are almost spherical, 3.5 μm in average length or diameter, and 1 in the aspect ratio, while the $Al_2O_3$ particles in the sample in Example 26 are oval-like, 3.5 μm in average length, and 2.0 in average aspect ratio.

The test piece of the Comparative Example 23 is the aluminum alloy extender defined as JIS No.2024 alloy and has the composition by weight of 4.4% of Cu, 1.5% of Mg, 0.6% of Mn, and the balance of Al.

The creep tests of these samples were carried out. The creep strength was defined as the tensile stress required to cause the test piece to have 0.1% of tensile strain after 1,000 hrs at 200° C. under the predetermined tensile stress. Table 5 shows the results of the creep tests as well as other properties.

TABLE 5

| Sample Number | Composition (Atomic %) | $Al_2O_3$ Vol % | Particle Size μm | Average Aspect Ratio | Tensile Strength | Elongation at break (%) | Impact Strength ($J/mm^2$) | Abrasion Loss (μm) | Creap Strength MPa | Evaluation |
|---|---|---|---|---|---|---|---|---|---|---|
| Example 25 | $Al_{91}Fe_6Ti_1Si_2$ | 5 | 3.5 | 1 | 400 | 8.0 | 0.17 | 0.1 | 129 | Good |
| Example 26 | $Al_{91}Fe_6Ti_1Si_2$ | 5 | 3.5 | 2.5 | 402 | 7.5 | 0.17 | 0.1 | 145 | Excellent |
| Comparative Example 23 | $Al_{96}Cu_2Mg_{1.7}Mn_{0.3}$ | — | — | — | — | — | — | — | 82 | N.G. |

The samples of Examples 25 and 26 show significant improvement in the creep strength, i.e. 129 and 145 MPa, respectively.

The reason will be explained as follows; since the test piece of Example 25 has fine α-aluminum matrix grains in the alloy, it is basically considered that the resistance to the creep (the creep strength) is low. However, the ceramic ($Al_2O_3$) particles in high volume content (5% in this case) which will cause not only the abrasion resistance but also heat resistance are dispersed in the matrix, therefore this sample offers better creep strength than the aluminum extender of Comparative Example 23.

A more effective method for further improvement in the creep strength is the addition of a hard ceramic ($Al_2O_3$) particles which depress the slip of the crystal particles. Of the shapes of the added ($Al_2O_3$) particles, the oblong shape offers a higher creep strength than the spherical shape because it is more difficult for the crystal particles to slip.

In general, the addition of oblong particles causes the decrease of toughness and ductility as compared with the addition of spherical particles. However, in the sample of Example 26, such disadvantages do not appear because it is difficult to concentrate the stress.

EXAMPLE 27 AND COMPARATIVE EXAMPLE 24

An example in which a aluminum alloy of the invention was applied to a valve spring retainer and valve lifter, specifically a valve spring retainer and valve lifter attached to the intake and exhaust valve of an engine will be explained with reference to Table 6.

Figure 7:
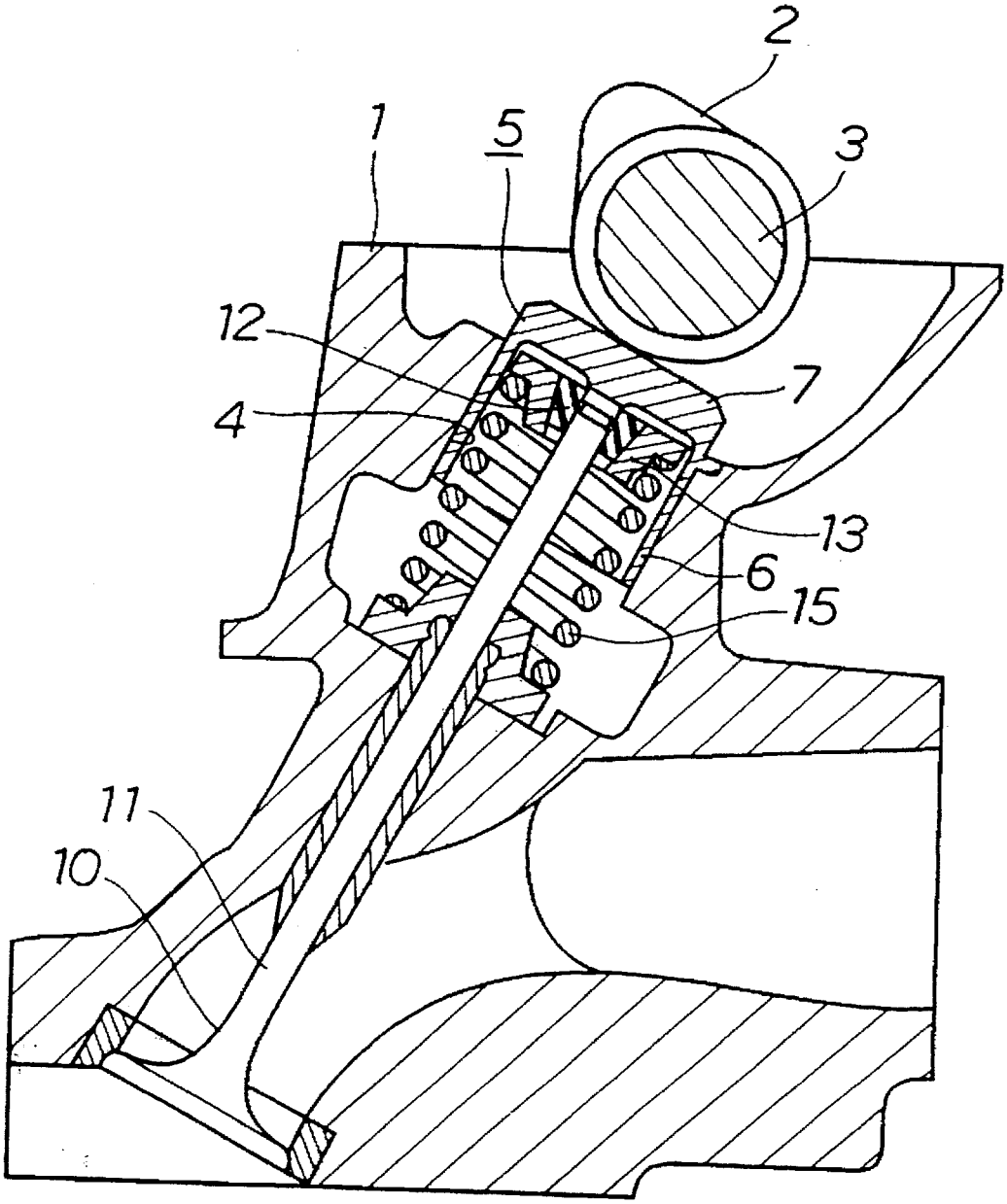
FIG. 7 is a sectional end view of an OHC (Overhead Camshaft) type valve operating mechanism for an internal combustion engine.

FIG. 7 is a cross section showing an OHC (Overhead Camshaft) type valve operating mechanism. The valve operating mechanism has a valve spring retainer and a valve lifter, which are both formed from the aluminum alloy of the invention. As shown in the Figure, it also includes in its cylinder head 1, a cam 2 to open and close the intake or exhaust valve 10, a cam shaft 3, a guide hole 4 bored in the cylinder head 1, and a valve lifter 5 slidably disposed within the guide hole 4. The valve lifter 5 is formed from the aluminum alloy of the invention.

Reference numerals 10, 11 and 12 respectively designate an intake (or exhaust) valve, a valve stem and a chock, which are formed from suitable materials (apart from the inventive aluminum alloy) known in the art. Designated by reference numeral 13 is a valve spring retainer which is formed from the aluminum alloy according to the invention.

Now, the action of the valve operating mechanism will be described. In the valve operating mechanism, the camshaft 3 controls gas exchange by directly driving the valve 10. When the camshaft 3 rotates about the axis perpendicular to the figure, the cam 2 slidably engages the upper surface of the upper wall 7 of the inverted-bottomed cylindrical valve lifter 5, the lower surface of the upper wall 7 engages the top of the valve stem 11, the outer surface of the side wall 6 slides in the guide hole 4 in the cylinder head 1, and the displacement of the cam 2 is transmitted to the valve 10 through the valve lifter 5. Consequently, the outer surface and the cam-engaging surface of the valve lifter 5 require excellent abrasion resistance.

Similarly, the flange part of the valve spring retainer 13 also requires excellent abrasion resistance because the valve spring 15 engages the flange part of the valve spring retainer 13 with the expansion and contraction of the valve spring 15 during displacement of the suction valve 10.

The durability tests of the above retainer 13 and lifter 5 made of the above aluminum alloy were carried out, and the results are shown in Table 6.

Degassing of the Green Compact

The green compact prepared was placed into a muffle furnace at 530° C. and allowed to degas for 25 minutes in an argon atmosphere.

Extrusion

The test piece was prepared based on the following indirect extrusion conditions:

| | |
|---|---|
| Inner diameter of container | 80 mm |
| Container temperature | 400° C. |
| Bore diameter of die | 25 mm |
| Die temperature | 400° C. |
| Extruding speed | 0.5 to 1.0 m/sec |

The retainer 13 and lifter 5 were formed from the material by cutting with machine work, and subjected to durability test with the actual valve for 100 hours. The abrasion loss of the spring engaging surface and the cam surface of the retainer 13 and the lifter 5 were 11 μm and 15 μm, respectively.

Comparative Example 24

A similar test was carried out for a sample and with the procedure described in Example 27, except this Comparative Example 24 did not contain $Al_2O_3$. The abrasion loss of the retainer 13 and the lifter 5 drastically increased to 580 μm and 620 μm, respectively, which are quite unsatisfactory results.

A forging of the retainer 13 was made instead of machine cutting retainer, as in Example 27, and tested. Satisfactory results were obtained.

These results demonstrate that the aluminum alloy of the invention is preferably used for the valve retainer 13 and valve lifter 5.

By this invention, controlling the fcc grain size of the matrix of α-aluminum and the grain size of the intermetallic compound to not more than 1 μm, in other words in the nanometer order, the stress concentration due to the intermetallic compound is reduced, and the stress concentration due to the ceramic particles is also reduced because the ceramic particles are dispersed so as to be surrounded with plural fine particles. Furthermore, in the powder molding and solidification process, a grain boundary sliding among the plastic deformations of individual powder predominates due to the nanometer order texture, the non-homogeneity of the individual powder is prevented effectively, and powders bind well to each other. As a result, decreasing toughness and ductility are satisfactorily depressed.

Furthermore, controlling the ceramic particle content to the low level causes an improvement in workability.

The TM (Fe or Ni) included in the aluminum alloy leads to an improvement in heat resistance. A TM content of less than 4.0 atomic percent causes low strength at a high temperature, while a content of more than 7.0 atomic percent

TABLE 6

| Sample Number | Matrix | $Al_2O_3$ (Vol %) | Heating Temperature (°C.) | Heating Time (min) | fcc Particle Size | IMC Particle Size (nm) | Retainer Abrasion (μm) | Lifter Abrasion (μm) | Evaluation |
|---|---|---|---|---|---|---|---|---|---|
| Example 27 | $Al_{91}Fe_6Ti_1Si_2$ | 3.0 | 400 | 18 | 500 | 200 | 11 | 15 | Good |
| Comparative Example 24 | $Al_{91}Fe_6Ti_1Si_2$ | 0 | 400 | 18 | 500 | 200 | 580 | 620 | N.G. |

Example 27

The material containing 3.0% by volume of $Al_2O_3$ in the $Al_{91}Fe_6Ti_1Si_2$ matrix was prepared so that the fcc grain size was 500 nm and the IMC grain size was 200 nm.

Preparation of Green Compact

The alloy having the composition of $Al_{91}Fe_6Ti_1Si_2$ (where the suffix means atomic percent) was air-atomized and classified to 45 μm or less. 3.0% by volume of $Al_2O_3$ particles having an average diameter of 3.5 μm were added to the alloy and the compound was mixed thoroughly. Then, a green compact billet of 78 mm in outer diameter by 50 mm in length was prepared from the mixture by CIP (Cold Isostatic Pressing) under the pressure of 4ton/cm$^2$.

offers poor toughness due to increasing the intermetallic compound. X (Ti, Zr, Mg, or a rare earth element) promotes the refining of the intermetallic compounds in the texture. The refining can not be achieved with an X content of less than 0.5 atomic percent, while a content over 3.0 atomic percent causes decreasing toughness due to the formation of an Al—X intermetallic compound.

The addition of Si to the aluminum alloy will lead to further refining of the texture. The Si content over 3.0 atomic percent causes decreasing toughness due to the precipitation of the primary Si crystals.

In the invention, when the shape of the ceramic particles is non-spherical having an oval-like cross section, the creep strength of the aluminum alloy will increase.

Because aluminum alloy based on the invention offers excellent workability, strength at a high temperature and abrasion resistance, the alloy is most preferably used for a valve spring retainer and valve lifter of an engine.

The following advantages will be provided by the above Examples of the invention; alloy of the present invention, because the grain size of the matrix of α-aluminum in the alloy is not more than 1,000 nm, the grain size of intermetallic compound contained in the alloy is not more than 500 nm, and 0.5 to 20% by volume of ceramic particles in the range of 1.5 to 10 μm in diameter are dispersed in the alloy, the stress concentration due to the added ceramic particles can be reduced. Furthermore, as the powders bind well to each other in the powder molding and solidification process, heat resistance and abrasion resistance can be compatibly improved without decreasing toughness and ductility.

In another prefered example of the present invention, the most suitable secondary workability can be achieved by limiting the ceramics particle content in the heat resistant and abrasion resistant aluminum alloy to 0.5 to 8% by volume.

In yet another preferred example of the present invention, the heat resistant and abrasion resistant aluminum alloy containing TM (Fe and/or Ni) offers improved heat resistance, and the alloy containing X (Ti, Zr, Mg, and rare earth elements) can promotes refining of intermetallic compound in the texture.

In still another preferred example of the present invention, the heat resistant and abrasion resistant aluminum alloy additionally containing Si will promote further refining of intermetallic compound in the texture.

In another preferred example of the invention, non-spherical ceramic particles having an oval like cross section, which are added to the heat resistant and abrasion resistant aluminum alloy, cause further improvement in creep strength.

Furthermore, a valve spring retainer and valve lifter based on another concept of the invention formed from the heat resistant and abrasion resistant aluminum alloy have excellent durabilities for use at a high temperature and for repeated loads.

What is claimed is:

1. A heat- and abrasion-resistant aluminum alloy comprising: matrix of α-aluminum contained in the alloy and having a grain size not larger than 1,000 nm; intermetallic compounds contained in the alloy and having a grain size not larger than 500 nm; and 0.5 to 20% by volume of ceramic particles dispersed in the alloy and having a particle size in the range of 1.5 to 10 μm.

2. A heat- and abrasion-resistant aluminum alloy according to claim 1, wherein the ceramic particle content is limited to the range of 0.5 to 8% by volume.

3. A heat- and abrasion-resistant aluminum alloy according to claim 1 or 2, wherein the aluminum alloy comprises $Al_{bal}TM_aX_b$, where TM is at least one element selected from the group consisting of Fe and Ni; X is at least one element selected from the group consisting of Ti, Zr, Mg and rare earth elements; and the suffixes a and b in atomic percentage are $4 \leqq a \leqq 7$ and $0.5 \leqq b \leqq 3$, respectively.

4. A heat- and abrasion-resistant aluminum alloy according to claim 1 or 2, wherein the aluminum alloy comprises $Al_{bal}TM_aX_bSi_c$, where TM is at least one element selected from the group consisting of Fe and Ni; X being at least one element selected from the group consisting of Ti, Zr, Mg and rare earth elements; and the suffixes a, b and c in atomic percent are $0.5 \leqq b3$, and $1 \leqq c \leqq 3$, respectively.

5. A heat- and abrasion-resistant aluminum alloy according to claim 1 or 2, wherein the shape of the ceramic particles is non-spherical having a substantially oval cross section.

6. A heat- and abrasion-resistant aluminum alloy according to claim 3, wherein the shape of the ceramics particle is non-spherical and has a substantially oval cross section.

7. A heat- and abrasion-resistant aluminum alloy according to claim 4, wherein the shape of the ceramic particle is non-spherical and has a substantially oval cross section.

8. A valve spring retainer for an engine, formed from a heat- and abrasion-resistant aluminum alloy, comprising:

matrix of α-aluminum contained in the alloy and having a grain size not larger than 1,000 nm; intermetallic compounds contained in the alloy and having a grain size not larger than 500 nm; and 0.5 to 20% by volume of ceramic particles dispersed in the alloy and having a particle size in the range of 1.5 to 10 μm.

9. A valve spring retainer according to claim 8, wherein the aluminum alloy comprises $Al_{bal}TM_aX_b$, where TM is at least one element selected from the group consisting of Fe and Ni; X is at least one element selected from the group consisting of Ti, Zr, Mg and rare earth elements; and the suffixes a and b in atomic percentage are $4 \leqq a \leqq 7$ and $0.5 \leqq b \leqq 3$, respectively.

10. A valve spring retainer according to claim 8, wherein the aluminum alloy comprises $Al_{bal}TM_aX_bSi_c$, where TM is at least one element selected from the group consisting of Fe and Ni; X is at least one element selected from the group consisting of Ti, Zr, Mg and rare earth elements; and the suffixes a, b and c in atomic percentage are $4 \leqq a7$, $0.5 \leqq b \leqq 3$ and $1 \leqq c \leqq 3$, respectively.

11. A valve lifter, for mounting between a valve and a camshaft of an engine, formed from a heat- and abrasion-resistant aluminum alloy, comprising:

matrix of α-aluminum contained in the alloy and having a grain size not larger than 1,000 nm; intermetallic compounds contained in the alloy and having a grain size not larger than 500 nm; and 0.5 to 20% by volume of ceramic particles dispersed in the alloy and having a particles size in the range of 1.5 to 10 μm.

12. A valve lifter according to claim 11, wherein the aluminum alloy comprises $Al_{bal}TM_aX_b$, where TM is at least one element selected from the group consisting of Fe and Ni, X is at least one element selected from the group consisting of Ti, Zr, Mg and rare earth elements; and the suffixes a and b in atomic percentage are $4 \leqq a \leqq 7$ and $0.5 \leqq b \leqq 3$, respectively.

13. A valve lifter according to claim 11, wherein the aluminum alloy comprises $Al_{bal}TM_aX_bSi_c$, where TM is at least one element selected from the group consisting of Fe and Ni, X is at least one element selected from the group consisting of Ti, Zr, Mg and rare earth elements; and the suffixes a, b and c in atomic percentage are $4 \leqq a \leqq 7$, $0.5 \leqq b \leqq 3$ and $1 \leqq c \leqq 3$, respectively.

14. A valve spring retainer according to claim 8, 9 or 10, wherein the ceramic particle content is limited to the range of 0.5 to 8% by volume.

15. A valve spring reainer according to claim 8, 9 or 10, wherein the shape of the ceramic particles is non-shperical and has a substantially oval cross section.

16. A valve spring retainer according to claim 14, wherin the shape of the ceramic particles is non-spherical and has a substantially oval cross section.

17. A valve lifter according to claim 11, 12 or 13, wherein the ceramic particle content is limited to the range of 0.5 to 8% by volume.

18. A valve lifer according to claim 11, 12 or 13, wherein the shape of the ceramic particle is non-spherical and has a substantially oval cross section.

19. A valve lifter according to claim 17, wherein the shape of the ceramic particles is non-spherical and has a substantially oval cross section.

* * * * *

UNITED STATES PATENT AND TRADEMARK OFFICE

CERTIFICATE OF CORRECTION

PATENT NO. : 5,658,366
DATED : August 19, 1997
INVENTOR(S) : Okamoto et al.

It is certified that error appears in the above-identified patent and that said Letters Patent is hereby corrected as shown below:

Column 14,
Line 20, after "atomic percent are" insert -- $4 \leq a \leq 7$, -- and delete "$0.5 \leq b3$" and substitute --$0.5 \leq b \leq 3$ --.
Line 54, delete "$4 \leq a7$" and subtitute -- $4 \leq a \leq 7$ --.

Column 16,
Line 1, delete "reainer" and insert -- retainer --.
Line 4, delete "wherin" and insert -- wherein --.
Line 9, delete "lifer" and insert -- lifter --.

Signed and Sealed this

Seventh Day of May, 2002

*Attest:*

*Attesting Officer*

JAMES E. ROGAN
*Director of the United States Patent and Trademark Office*